US006375145B1

(12) United States Patent
Payne

(10) Patent No.: US 6,375,145 B1
(45) Date of Patent: Apr. 23, 2002

(54) WATER FILLED BALLASTS FOR SWING SETS

(76) Inventor: David M. Payne, 2729 N. Mule Deer Way, Meridian, ID (US) 83642

( * ) Notice: Subject to any disclaimer, the term of this patent is extended or adjusted under 35 U.S.C. 154(b) by 0 days.

(21) Appl. No.: 09/502,582

(22) Filed: Feb. 11, 2000

(51) Int. Cl.[7] ..... A47B 97/00
(52) U.S. Cl. ..... 248/500; 472/118
(58) Field of Search ..... 248/500, 158, 248/162.1, 406.2, 163.1, 910; 472/118, 120, 124, 119, 125

(56) References Cited

U.S. PATENT DOCUMENTS

| | | | | | |
|---|---|---|---|---|---|
| 3,665,882 | A | * | 5/1972 | Tancho | 114/266 |
| 3,974,604 | A | | 8/1976 | Conn | 52/160 |
| 4,102,137 | A | * | 7/1978 | Porraz et al. | 61/38 |
| 4,786,053 | A | | 11/1988 | Barnes, Jr. | 273/1.5 R |
| 4,863,137 | A | | 9/1989 | Cockman | 248/545 |
| 5,010,698 | A | | 4/1991 | Hugron | 52/160 |
| 5,259,612 | A | | 11/1993 | Matherne et al. | 273/1.5 R |
| 5,815,856 | A | * | 10/1998 | Dore | 4/657 |
| 5,862,967 | A | * | 1/1999 | Johnson | 224/577 |
| 6,061,969 | A | * | 5/2000 | Leary | 52/2.11 |
| 6,099,207 | A | * | 8/2000 | Bennett | 405/199 |
| 6,117,027 | A | * | 9/2000 | Davis et al. | 473/481 |

* cited by examiner

*Primary Examiner*—Ramon O. Ramirez
*Assistant Examiner*—A. Joseph Wujciak
(74) *Attorney, Agent, or Firm*—Burkhart & Burkhart; Anne K. Burkhart; Patrick N. Burkhart

(57) ABSTRACT

A ballasting device for swing sets having an expansible/expandable or semi-rigid body capable of holding a ballasting medium, preferably water, a means of attaching to a swing support and an integral safety padding system. One of the ballast's functions is to help prevent the swing from tipping. Another of its functions is to prevent injury due to impact with the swing set's leg supports. This ballast is designed to quickly and easily attach to existing, high volume, metal tubing swing sets. Through the use of this ballast, the swing set remains highly mobile when drained, yet in a substantially rigid position during use of the swing/ballast system. Integral padding is provided by the very existence of the ballast and its filler, both of which are considerably more pliable and soft than steel, aluminum or wood.

12 Claims, 17 Drawing Sheets

WATER FILLED BALLASTS FOR SWING SETS

BACKGROUND—FIELD OF INVENTION

The field of invention relates to yard swing arrangements, or swing sets, and more particularly pertains to a new and improved method of anchoring or stabilizing a swing set to prevent tipping while it is being ridden and pads the swing legs to help prevent injury due to collision with the swing.

BACKGROUND—DESCRIPTION OF PRIOR ART

Swing sets of various types are utilized in the prior art and are typically positioned upon a supporting ground surface, or are alternatively mounted within concrete anchors and the like. Some swing sets are anchored with stakes that are driven into the ground.

Several swing sets that are currently on the market have warning notices in the box exhorting the owner to properly anchor the swing before operation. This warning is provided because of the swing set's tendency to tip or rock as an operator swings higher and faster. This tipping action can be dangerous to the rider and other beings near the swing.

The literature provided with common swing sets suggests one of two solutions to remedy the problem; one, cement the legs of the swing permanently in the ground and two, use metal stakes to anchor the swing legs to the ground. Both of these solutions have several limitations that make them inconvenient, impractical and therefore, seldom used, resulting in dangerous swings.

First, there is definitely a high level of permanence with the cement solution. The average American moves once every five years, most do not want to buy, and assemble, a new swing set with that frequency. Some people like their swing set to have mobility within their yard. This mobility is useful when mowing the lawn, playing games or in order to avoid unsightly brown patches under the swing's high traffic areas. A marketing survey has shown that approximately ninety percent of these types of swing set owners do not anchor their swings for reasons of maintaining mobility.

Second, this anchoring method is not as easily executed. Many people do not want to dig holes in their yard. Many more are not comfortable with concrete work and would have to solicit help in order to anchor their swing with this method. Also, when holes are dug to cement the swing legs in place, the underlying system of sprinkler pipe can be damaged.

Third, this means of anchoring eliminates one safety problem but creates another. Cement anchors the swing so well that the swing becomes a very rigid space frame system. This can be dangerous to children who may run into the swing during play. Because of the rigid nature of the cemented structure it has virtually no give upon impact. An impact of this nature, with such a rigid structure, can cause traumatic bodily injury.

In addition, cementing the swing into the ground is seen as a hassle and the pending task is soon forgotten. The cement anchoring system is not readily available in a clean, easy to use kit form made specifically for swings. This system puts the burden of procurement and assembly on the user.

Lastly, cementing the swing legs several inches in the ground lowers the overall height of the swing, which diminishes the thrill of the ride.

In the case of the stake anchoring system, the hardware is not easy to find, assemble or attach properly. The stake anchoring system is achieved by procuring some perforated metal strap, metal stakes, nuts and bolts necessary to attach the strap to the legs of the swing. Once the strap is bolted around each of the legs of the swing, the stakes are driven through exposed loops in the strap and driven several inches into the ground. The task is daunting and the remaining exposed stake tops can be very dangerous to children at play on or around the swing. In addition to potential cuts, abrasions and puncture wounds, this system also renders a very rigid, truss-like, structure that is dangerous in impact situations. The stake anchoring system also has a level of permanence that is undesirable.

Finally, this type of anchoring system can also cause expensive damage to underlying sprinkler system pipe. Modem sprinkler systems are buried as shallow as six inches in the ground. When a pointed metal stake strikes the plastic pipe it likely will be weakened or punctured.

Other ballasting or anchoring systems have been proposed, but not necessarily for swing sets—for example U.S. patents 5259612 to Matherne et al. (1993), 5,010,698 to Hugron (1991), 3,974,604 to Conn et al. (1976), 4,863,137 to Cockman et al. (1989)

4,786,053 to Barnes (1988)

All of these anchoring systems are large, heavy, complex, rigid, potentially dangerous and expensive to package, ship and manufacture. Most of these are not available in stores or packaged specifically for swing set application.

SUMMARY

In accordance with the present invention, a ballasting device for swing sets comprises a container capable of holding a ballasting medium, a method of attaching the ballast to a swing, a valve to fill and drain the ballast and an integral safety padding system.

Objects and Advantages

Accordingly, advantages of my swing set ballast are:

(a) to provide a swing ballasting device that helps prevent a swing from tipping over while excessive riding is taking place;

(b) to provide a swing ballasting device that is easy to find and purchase;

(c) to provide a swing ballasting device that requires little or no assembly;

(d) to provide a swing ballasting device that requires no tools to attach to the swing;

(e) to provide a swing ballasting device that still allows for mobility of the swing;

(f) to provide a swing ballasting device that helps prevent injury due to impact with the structure of the swing;

(g) to provide a swing ballasting device that will not cause any damage to the lawn or sprinkler system above that which the swing set may cause on its own;

(h) to provide a swing ballasting device that has a form and weight factor conducive to inexpensive shipping rates;

(i) to provide a swing ballasting device that has a form and weight factor conducive to inexpensive packaging;

(j) to provide a swing ballasting device that will pose no danger to children playing on or around the swing;

(k) to provide a swing ballasting device that can come in an assortment of colors and will add aesthetic value to the swing;

(l) to provide a swing ballasting device that can be easily manufactured;

(m) to provide a swing ballasting device that can be easily marketed;

(n) to provide a swing ballasting device that is susceptible of a low cost of manufacture with regards to both materials and labor;

(o) to provide a swing ballasting device that is economically available to the buying public;

(p) to provide a swing ballasting device that can be easily added to swing sets already in use.

Further advantages are to provide a swing-ballasting device that can be used without damage to the swing (scratch off paint and cause subsequent rust formations). Still further advantages will become apparent from a consideration of the ensuing description and drawings.

DRAWING FIGURES

The invention will be better understood and advantages other than those set forth above will become apparent when consideration is given to the following detailed description thereof. Such description makes reference to the drawings listed below:

FIG. 1 is a perspective view of a first embodiment showing the bottom half of the main body tube folded up, into the top portion and threaded through a structural hub.

FIG. 2 is a perspective view of a first embodiment on one side of a swing.

FIG. 3 is a perspective view of a second embodiment after the ends are welded shut with the retaining strap in place.

FIG. 4 is a perspective view of the second embodiment on all four legs of a swing.

FIG. 5 is a perspective view of a third embodiment.

FIG. 6 is a perspective view of the third embodiment on one side of a swing.

FIG. 11 is a perspective view of a folded and welded eighth embodiment main body with valves (note "quilted" appearing structural welds).

FIG. 12 is an elevation view of an eighth embodiment on one side of a swing.

FIG. 13 is a perspective view of a ninth embodiment.

FIG. 14 is a perspective view of a ninth embodiment on one side of a swing.

Reference Numerals in Drawings

Figure 1:
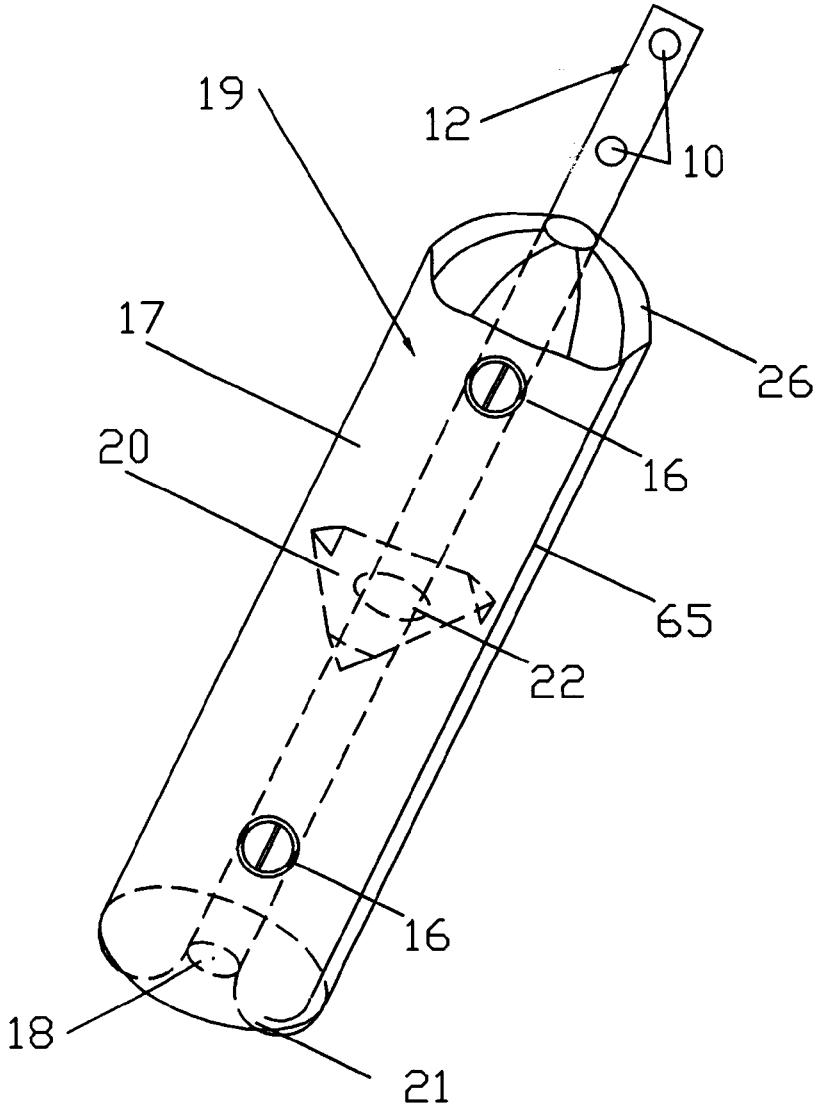
FIGS. 1 and 2 are drawings of a first embodiment.

10 (1) set of snaps on the retaining strap
11 swing set
12 retaining strap
13 swing set cross member
16 drain/fill valves
17 main body tube
18 center tube or cylinder (unique part or formed by folding or molding)
19 first embodiment with the top end welded shut and the retaining strap, center hub and valves in place
20 structural center hub, triangular (optional)
21 fold line
22 hole or void in center hub
26 welded ends of inner and outer tubes or cylinders
29 second embodiment with the ends welded shut and the retaining strap in place
30 main body of a third embodiment
34 welded assembly of the main body of the third embodiment shown with perforations down the long edges
36 perforations or holes down the long edges of the main body assembly
38 fourth embodiments assemble
40 fifth embodiments assemble
42 sixth embodiments assemble
44 bellows in sixth embodiments assemble
46 seventh embodiments assemble
48 end caps on seventh embodiments assemble
50 rigid center tube of seventh embodiments assemble
52 flexible outer tube of seventh embodiments assemble
54 eighth embodiments assemble
56 "quilted" spot-welded buttons to maintain geometry or shape of eighth embodiment
58 nylon tie wraps or similar method of connecting eighth embodiment to the swing
60 welded seam around the periphery of eighth embodiment (excluding fold line)
62 small holes or perforations through the welded seam around the periphery of eighth embodiment through which (58) is threaded
64 ninth embodiment rolled and welded main body tube assemble
65 weld line or seam
66 draw strap or cinch strap for closing and sealing ends (or other method)
68 open top (closed with 66)
70 sealed or leak resistant cuff
72 swing legs themselves is made into a container capable of holding ballasting medium
74 bladder for leg of swing
76 swing leg assembly
78 ballasting medium

DESCRIPTION OF THE INVENTION

A first embodiment of the present invention is illustrated in FIG. 1. The ballast is made from three primary pieces shown in FIGS. 1 and 2. The primary pieces are the retaining strap (12), the main body tube (17) and the optional structural center hub (20). The retaining strap (12) is one possible means to attach the ballast to the swing. Other means to attach the ballast to the swing might include snaps, belts, hook and loop fasteners, nylon cable ties, ropes, cords or a kind of snap fitting feature that could be molded of fabricated right into the body of the ballast. The main body tube (17) is the main body of the ballast. The structural hub (20) is a means to provide structural support to the middle region of the ballast and hold its walls in relative proximity to the swing leg once the container is filled with a ballasting medium (78). The structural hub (20) is not absolutely necessary but can help maintain a constant padding layer thickness around the circumference of the swing leg.

Other means of providing structural support to the middle region of the ballast might include, but are not limited to: rigid wheel like spacers that could be placed in the body of the ballast, an air inflatable diaphragm on the inside of the ballast, a cylindrical piece of foam rubber placed between the inner and outer walls of the ballast, and significant air/water pressure as to help the ballast maintain its shape.

Each of the primary pieces is cut from a sheet of readily available polymer fabric, preferably, but not necessarily, a fiber-reinforced thermo plastic. The material could be a material similar to that which whitewater rafts are made for example, vinyl coated PVC. The ballast could also be thermoformed (rot-molded, vacuum formed, injection molded or blow molded) or molded one-piece polymer. Use of thermoplastics is desirable due to their ability to be Radio Frequency (RF) or otherwise welded with heat. Welding of thermoplastics is clean, fast, and inexpensive. Two of the primary pieces have OEM type parts pre-assembled on them, namely, a set of mating snaps (or other fastening device such as hook and loop fasteners, hooks, cords etc.) (10) on the retaining strap (12) and at least one valve, or other means of filling/draining the container, (16) on the main body tube (17). The snaps (10) are used to fasten the retaining strap (12) around the swing cross bar (13) back onto itself. Other means of filling and draining the ballast might be, but are not limited to: self sealing orifices, plug able holes or voids in the ballast container, check valves, and other closable openings in the material.

Figure 2:
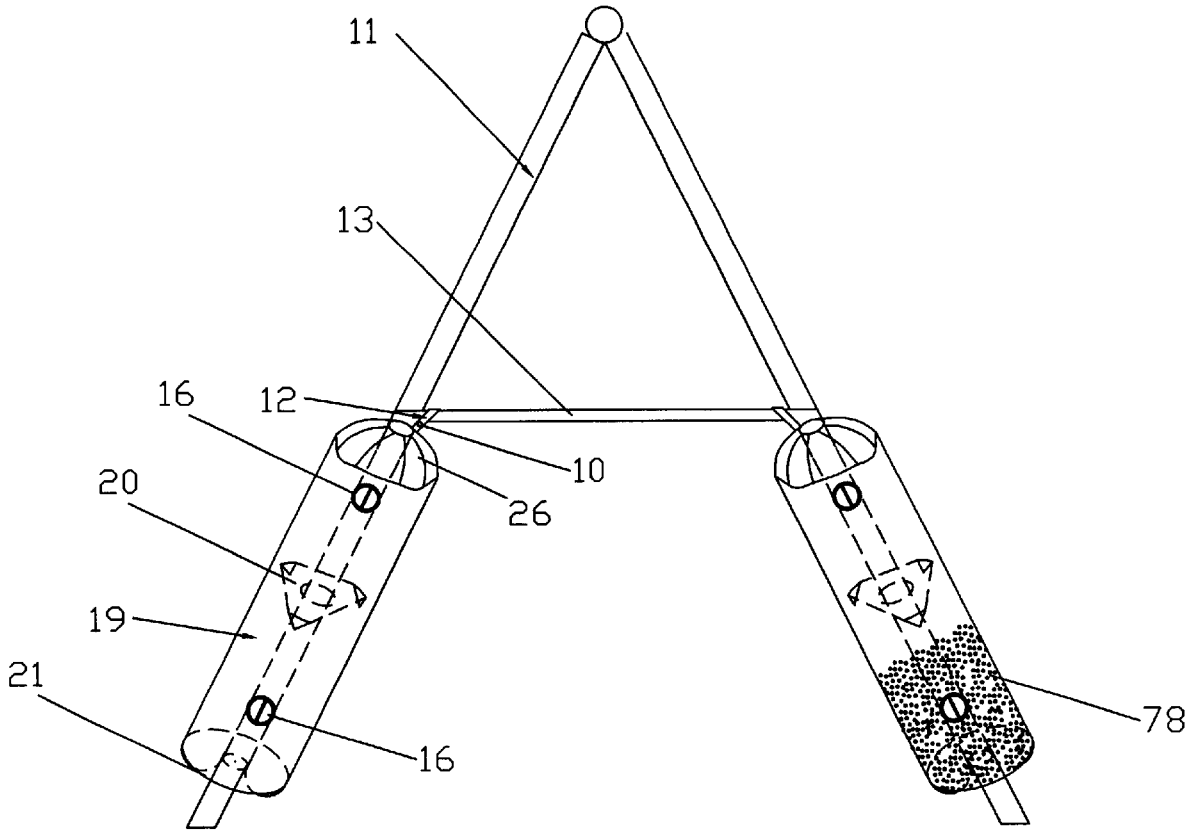

Before the main body tube (17) is rolled up and welded, or otherwise bonded, into a cylinder, the structural hub (20) must be welded in place (if it is to be used). The corners of the triangular structural hub (20) are folded over and welded to the inside of the main body tube (17) one fourth the length down from the top lengthwise and evenly spaced across the width. Once the structural hub (20) is welded in place, the main body tube (17) can be rolled and welded (65) up its long edge. The lower half of the main body tube (17) can be folded to the inside of the top half and threaded up through the top portion of the main body tube (17) and structural hub hole (22). Next, the ends of the main body tube (17) (top and bottom) can be welded (26) together at the top. This forms a not necessarily watertight vessel, largely cylindrical in shape, with an open-ended center tube (18) running down its centroidal axis. Finally, the retaining strap (12) can be welded in place inside the top end of the main body tube assembly (19). Two of the finished ballasts are shown in FIG. 2, filled with water, hanging from the cross member (13) of the swing by each ballasts' retaining strap (12). The resulting ballast also acts as a suitable pad covering the lower portion of the swing leg it is attached to. This first embodiment is the preferred embodiment due to several reasons:

simple design,
minimal parts,
minimal tooling,
optimal pad design,
optimal size,
minimal cost.

Figure 3:
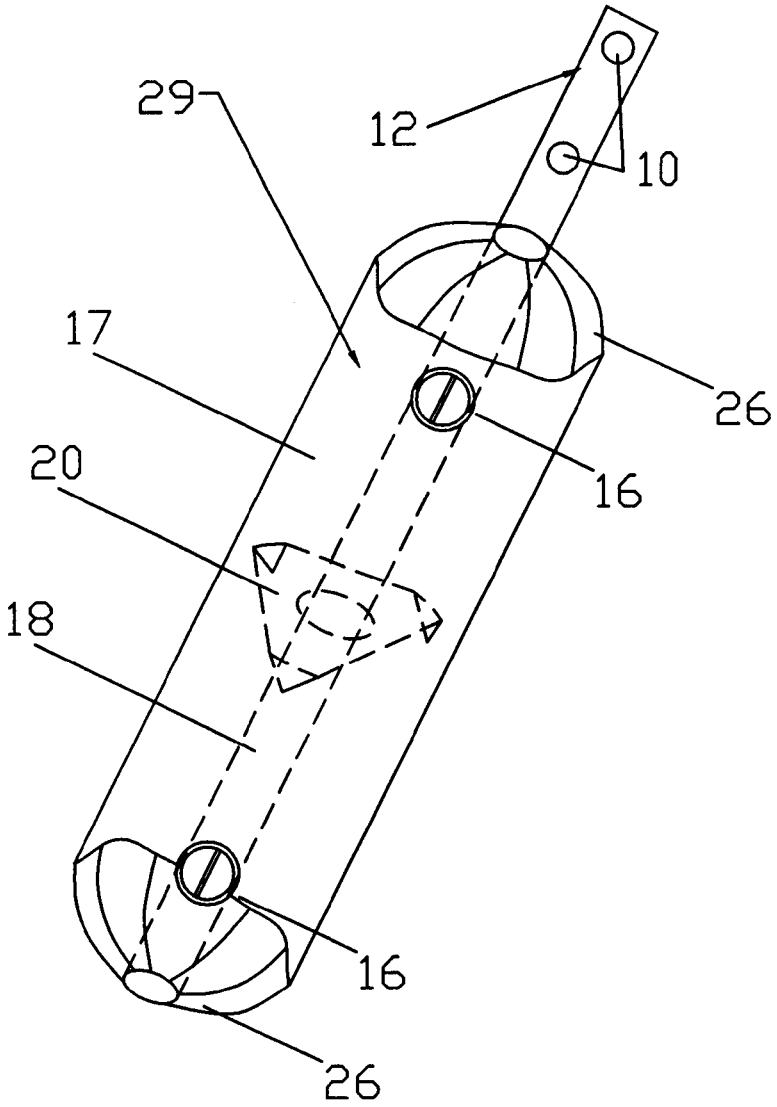
FIGS. 3 and 4 show a second embodiment.
Figure 4:
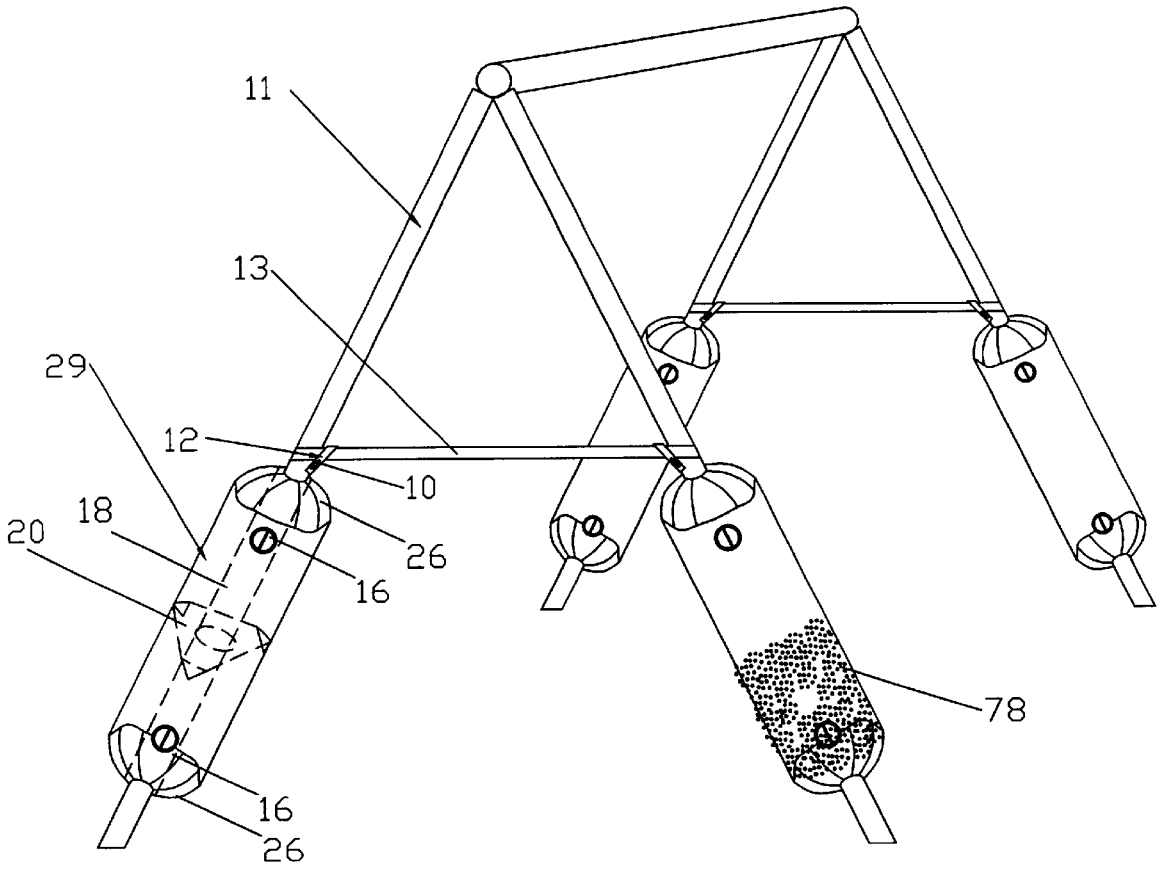

Additional embodiments are shown in FIGS. 3 through 16. FIGS. 3 and 4 show an embodiment very similar to that of the first embodiment. It has an additional, unique part, the center tube or cylinder (18), which, is not part of the main body tube (17). Both ends need to be welded (26) or sealed shut in order to hold water. The top weld or seam does not necessarily need to be watertight, as gravity will hold the ballasting material in the bottom.

The ballast is made from four primary pieces. Each of the primary pieces can be cut from a sheet of readily available polymeric fabric, preferably but not necessarily, fiber reinforced thermo plastic. The material could be similar to that which whitewater rafts are made, for example, vinyl coated PVC. This ballast could also be thermoformed in one piece, thereby eliminating some manufacturing steps and cost. The primary pieces are the retaining strap (12), the main body tube (17), the center tube (18) and the structural center hub (20). The structural center hub is optional as explained in the first embodiment. Two of the primary pieces have Original Equipment Manufacturer (OEM) type parts pre-assembled on them, namely, a set of mating snaps (10) on the retaining strap (12) and two fill/drain valves (16) on the main body tube (17). The snaps (10) are used to fasten the retaining strap (12) around the swing set cross member (13) back onto itself.

Before the main body tube (17) is rolled up and welded into a cylinder the structural hub (20) must be welded in place if it is to be used. The corners of the triangular structural hub (20) are folded over (21) and welded to the inside of the main body tube (17) in the center of the tube lengthwise. Once the structural hub (20) is welded in place, the main body tube (17) can be rolled and welded up its long edge. Similarly, the center tube (18) is rolled and welded up its long edge forming a long slender cylinder.

The center tube (18) can be threaded up through the main body tube (17) and structural hub hole (22) assembly and the ends of center tube (18) and main body tube (17) can be welded (26) together (FIG. 3). This forms a not necessarily watertight vessel (29), largely cylindrical in shape, with an open ended hollow cylinder (18) running down its centroidal axis. The bottom of this ballast must be watertight but the top need not be. Finally, retaining strap (12) can be welded in place inside the top portion of (18). Four of the finished ballasts are shown in FIG. 4 filled with water, hanging from the cross member (13) of the swing by each ballasts retaining strap (12).

Figure 5:
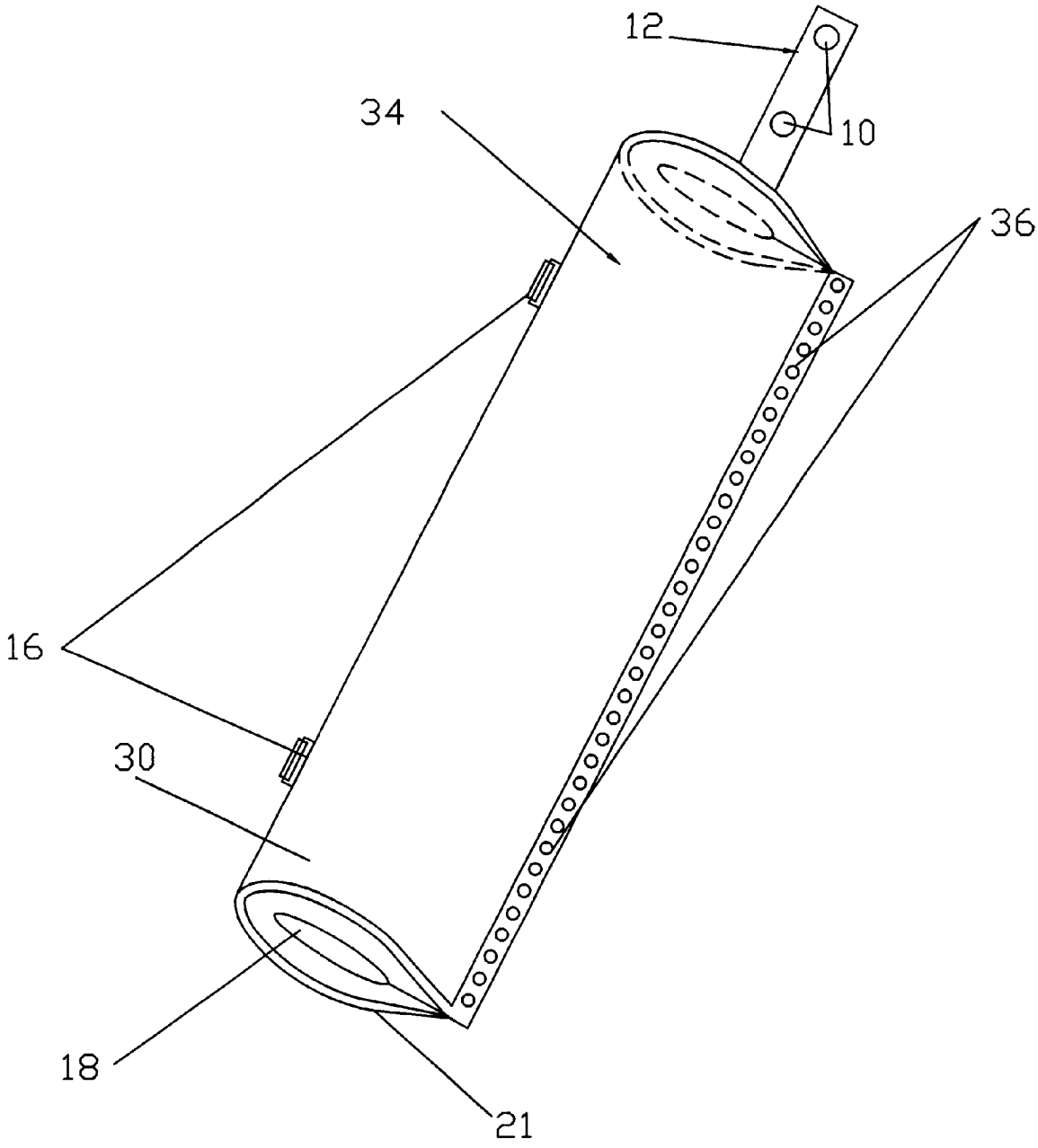
FIGS. 5 and 6 show a third embodiment.
Figure 6:
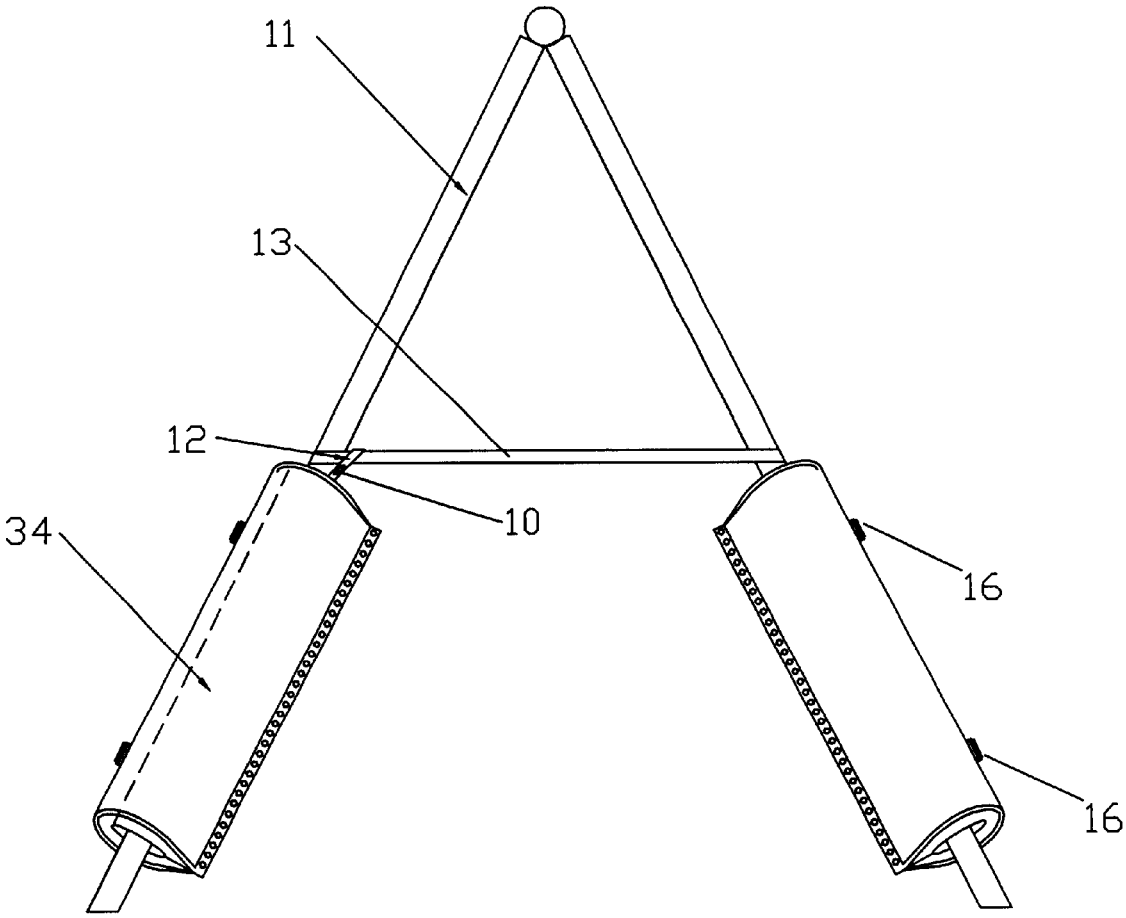

FIGS. 5 and 6 show one possible construction method for the third embodiment. The embodiment shown in FIGS. 5 and 6 is made with a main body tube or sheet (30). This ballast too can be made of an assembly of polymeric fabric or thermoformed in one piece. The main body sheet will have at least one fill/drain valve (16) already attached. This sheet is folded (21) down the middle and then its remaining three edges are bonded together, either by a glue, cement, solvent or heat to form a vessel or container. Ample room can be left on the two long edges to allow for perforation (36). The assembly can then be folded or rolled down its center to form a cylinder like vessel with a cross section similar to that of a horseshoe (see FIG. 5).

This embodiment can be affixed to the swing any number of ways. The preferred method would be to fold the assembly (34) around the leg of the swing set with at least one of the perforations (36) above the cross bar (13) of the swing. The assembly can then be stitched around the leg by way of the perforations (36) and a cord or some other device for fastening (58) such as nylon cable ties, hook and loop fasteners, hooks, snaps etc. This embodiment can also be attached to the swing via a retaining strap (12) as in the case of the first embodiment (FIG. 1).

Figure 7:
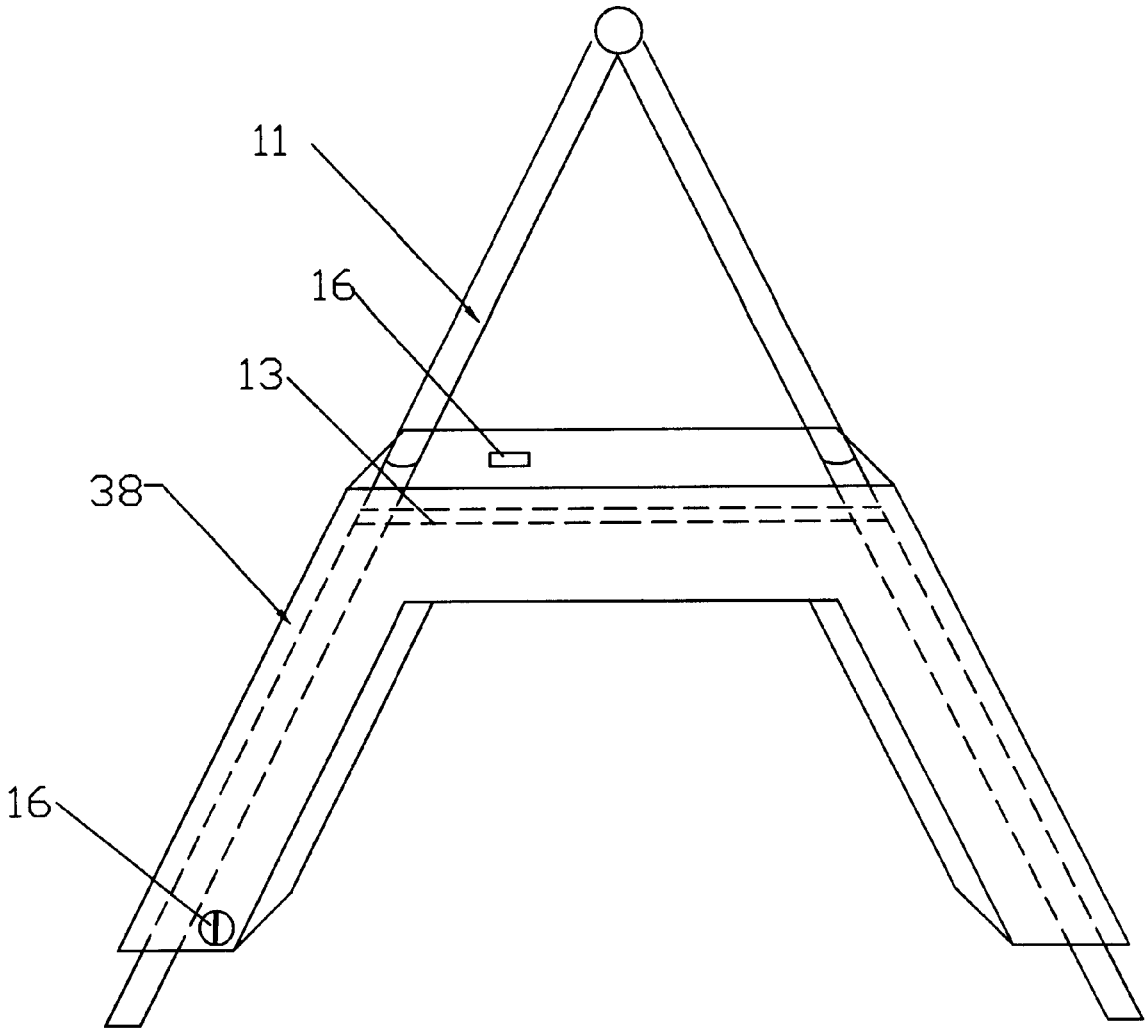
FIG. 7 is a perspective view of a fourth embodiment on one side of a swing.

Another embodiment is shown in FIG. 7. It is a thermoformed (rot-molded, vacuum formed, injection molded or blow molded) thermoplastic. It is a molded, one piece, vessel (38), that simply snaps and hangs onto one side of the swing set ("A" shaped structure). It, like all the others depicted, has at least one fill/drain valve (16). Because of its polymeric nature, it too, provides an added measure of impact absorption, and thus, safety to those playing on or around the modified swing. All edges of the ballasts would have sufficient radiuses to prevent injury from rubbing or bumping into a corner. In other words, this type of thermoformed plastic can be made with no sharp edges or corners and soft enough to help mitigate impacts. This embodiment holds approximately two times the amount of ballasting material as is found in the first embodiment.

Figure 8:
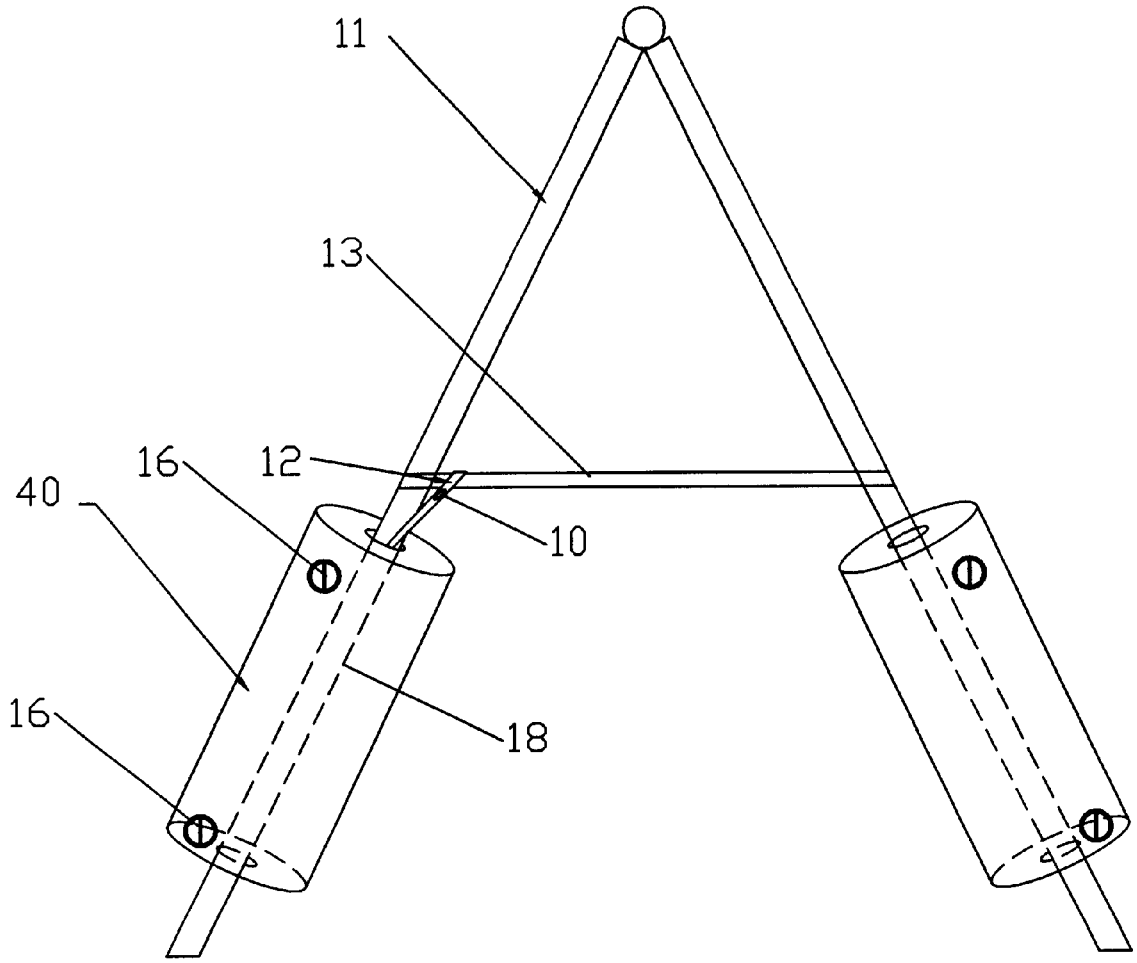
FIG. 8 is a perspective view of a fifth embodiment on one side of a swing.

Another embodiment is shown in FIG. 8. They too are made of thermoformed (rot-molded, vacuum formed, injection molded or blow molded) thermoplastic like FIG. 8, but, in this embodiment, there are two vessels (40) or ballasts per side of the swing ("A" shaped structure), one on each leg. They, like the other embodiments depicted, have at least one fill/drain valve (16) per vessel. This embodiment is mounted by sliding it up and onto a swing leg. It is attached securely to the swing by way of a retaining strap (12) (or other device) similar to the ones used in the first embodiment (FIG. 1). Because of their polymeric nature, this embodiment also provides an added measure of impact absorption, and thus, safety to those playing on or around the modified swing. Again, all edges of the ballasts would have sufficient radiuses to prevent injury from rubbing or bumping into a corner. In other words, this type of thermoformed plastic can be made with no sharp edges or corners and soft enough to help soften impacts.

Figure 9:
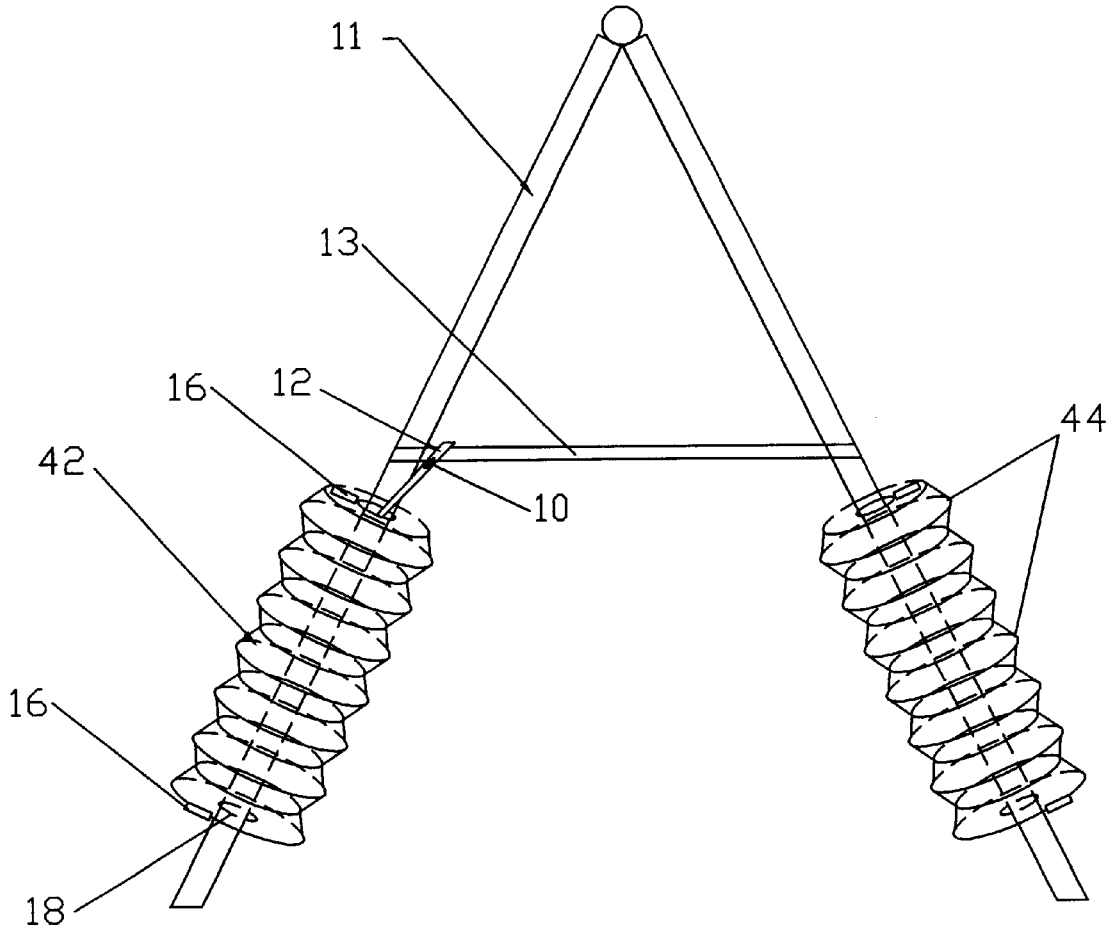
FIG. 9 is a perspective view of a sixth embodiment on one side of a swing.

FIG. 9 shows a derivation of FIG. 8. This embodiment (42) has similar construction and manufacturing processes as the fourth and fifth embodiments (38 and 40). It is collapsible due to the integrally formed bellows (44) that serve as the vessels inner and outer walls. Like all the others depicted, it has at least one fill/drain valve (16) per vessel. This embodiment is mounted by sliding it up and onto a swing leg. It is attached securely by way of a retaining strap (12) (or other device) similar to the ones used in the first embodiment (FIG. 1). Because of the ballasts' polymeric nature, this embodiment also provides an added measure of impact absorption, and thus, safety to those playing on or around the modified swing. All edges of the ballasts would have sufficient radiuses to prevent injury from rubbing or bumping into a corner.

Figure 10:
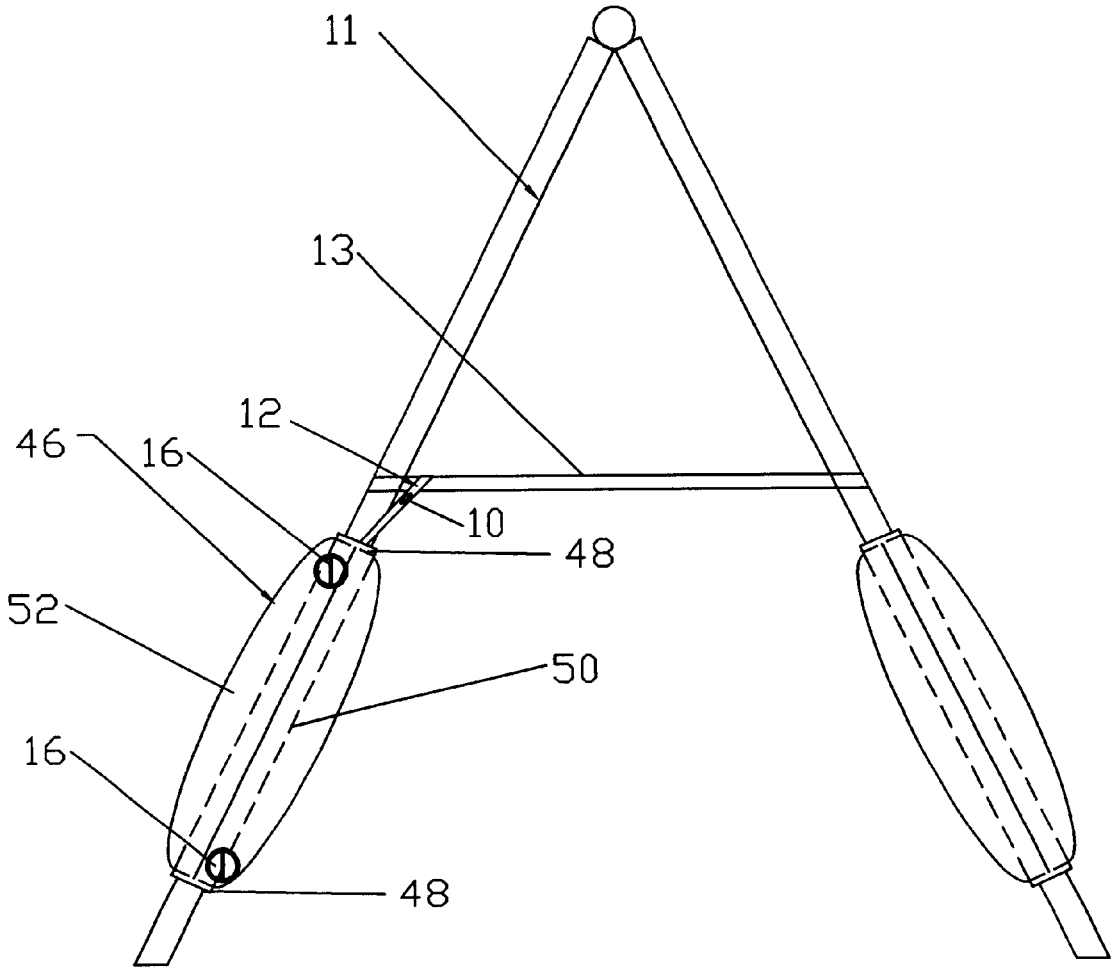
FIG. 10 is an elevation view of a seventh embodiment on one side of a swing.

There are various possibilities with regards to the hybridization of all the above listed embodiments. One such hybrid is shown in FIG. 10. This embodiment (46) is a combination of the embodiments shown in FIGS. 1 and 8. This particular ballast design incorporates a semi-rigid thermoplastic center tube (50) and a flexible polymeric fabric or thermoplastic outer wall or outer cylinder (52). The flexible outer wall, largely cylindrically shaped, is attached to the rigid inner tube by way of welding, glue, solvent, cement or end caps (48) or some combination of two or more of the preceding. Like all the others depicted, this embodiment has at least one fill/drain valve (16) per vessel. This embodiment is mounted by sliding it up and onto a swing leg. It is attached securely by way of a retaining strap (12) similar to the ones used in the first embodiment (FIG. 1).

Figure 11:
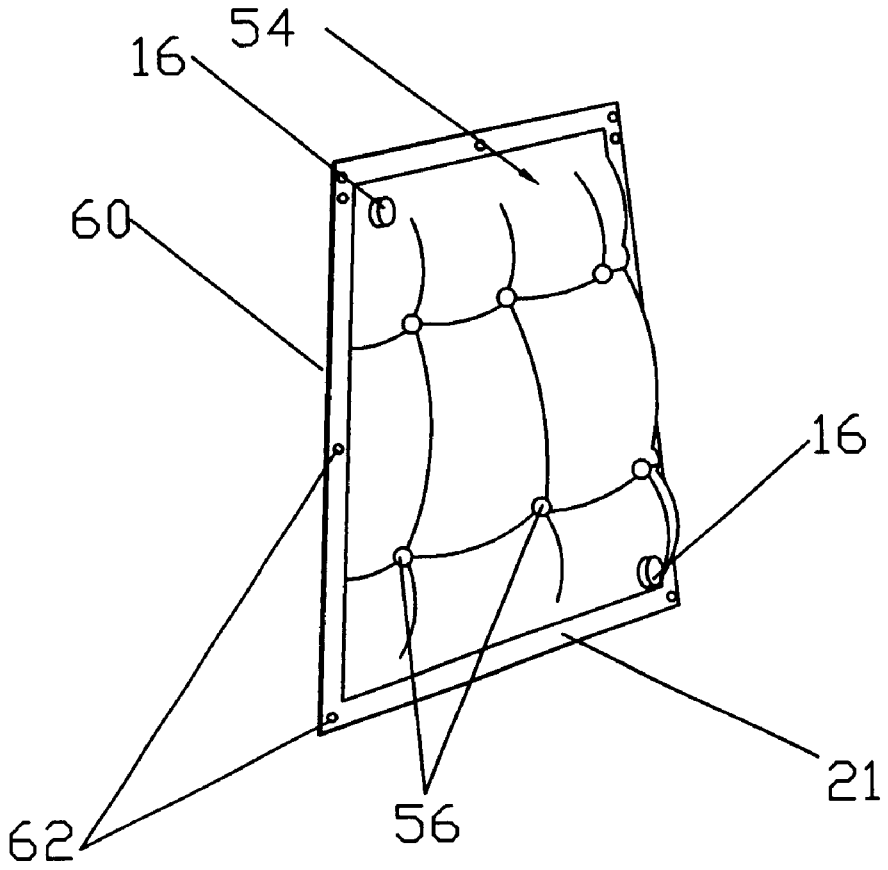
FIGS. 11 and 12 show the eighth embodiment.
Figure 12:
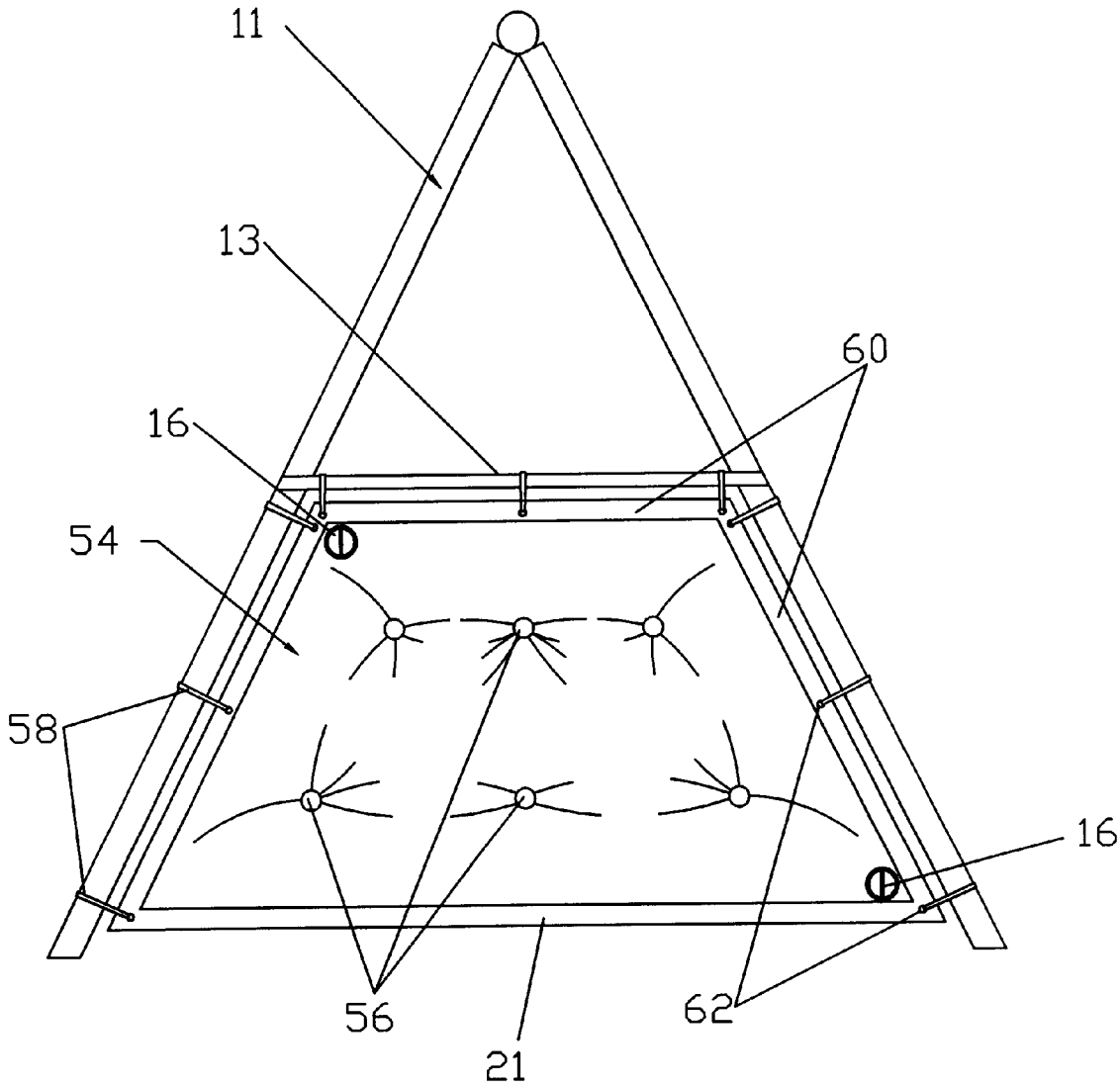

Yet another embodiment, the eighth embodiment (54), is shown in FIGS. 11 and 12. This embodiment is made of flexible, thermoplastic type, sheet material or polymeric fabric, as in the first embodiment. It can be made of one large sheet folded down the middle fold line (21) and welded in several strategic places (56) (optional) to provide yet another structure means similar to the optional structural hub (20) in the first embodiment. The remaining three sides of the ballast would then be welded (or otherwise bonded) to form seams (60) of substantial width to allow for perforation (62). These perforations (62) are then used to fasten the ballast to the swing structure. This is accomplished by some type of fastening device (58) such as nylon tie wraps or a cord of some sort. The body of the vessel (54) has at least one fill/drain valve (16). The resulting ballast resembles a trapezoidal inflatable mattress with perforations around three sides.

Figure 13:
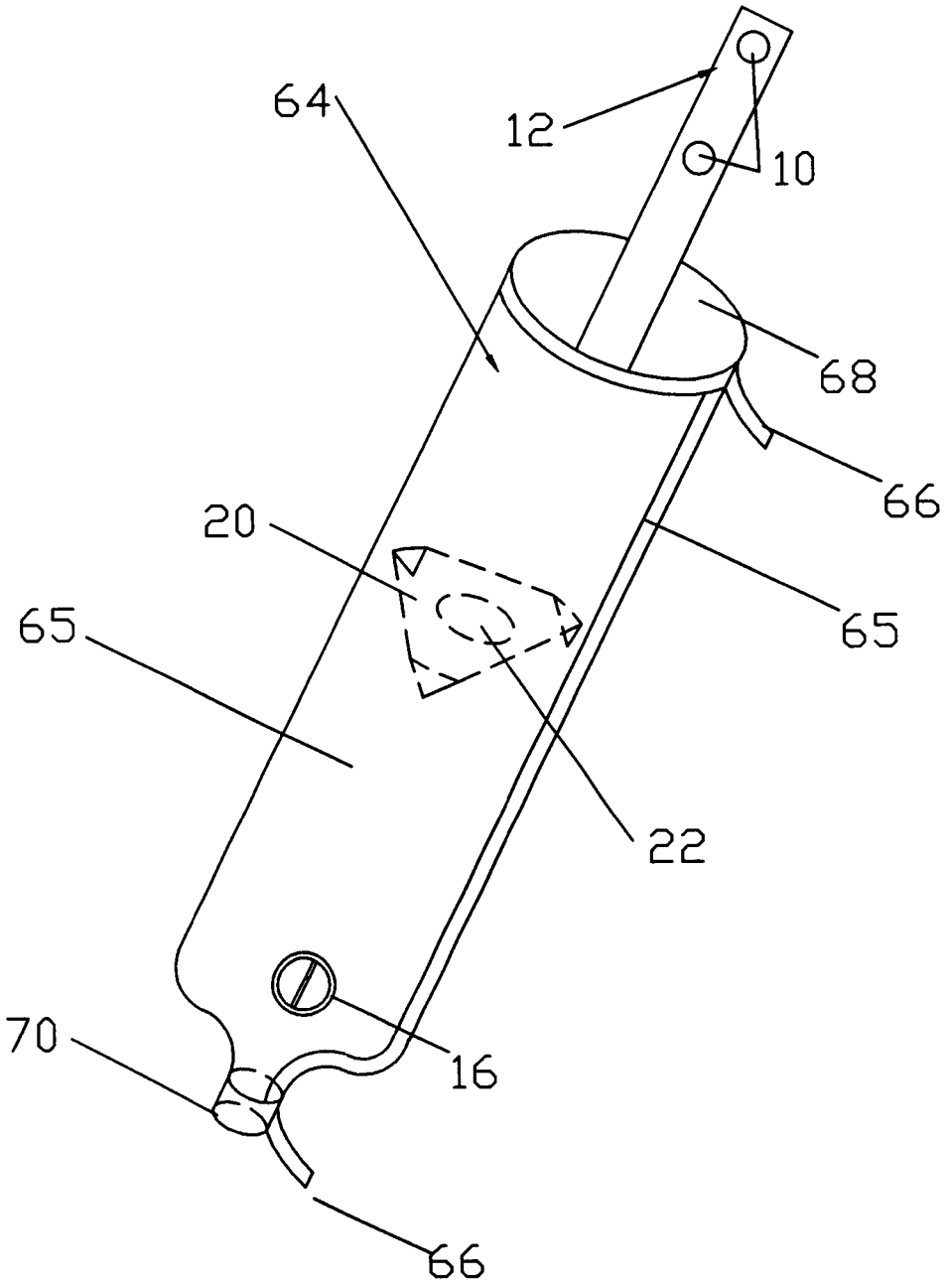
FIGS. 13 and 14 show the ninth embodiment.
Figure 14:
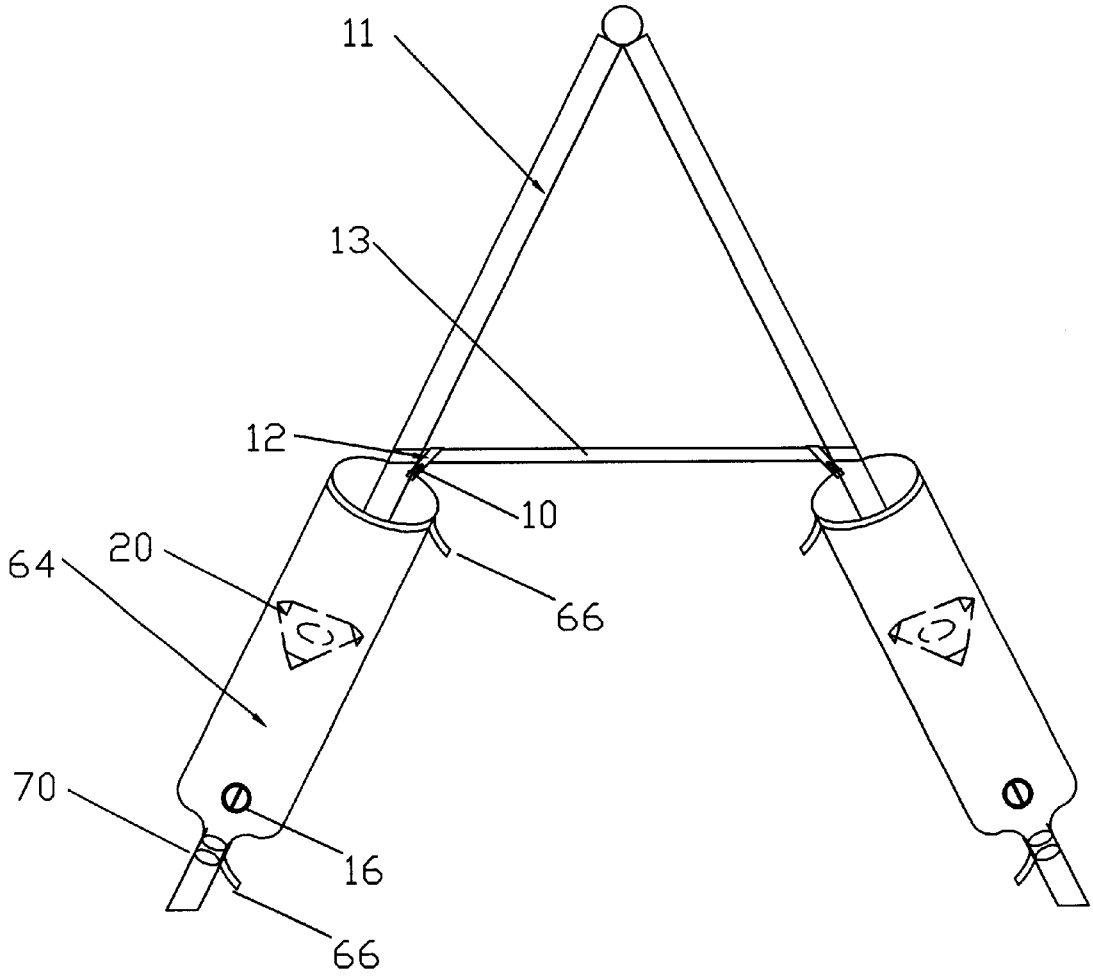
Figure 15:
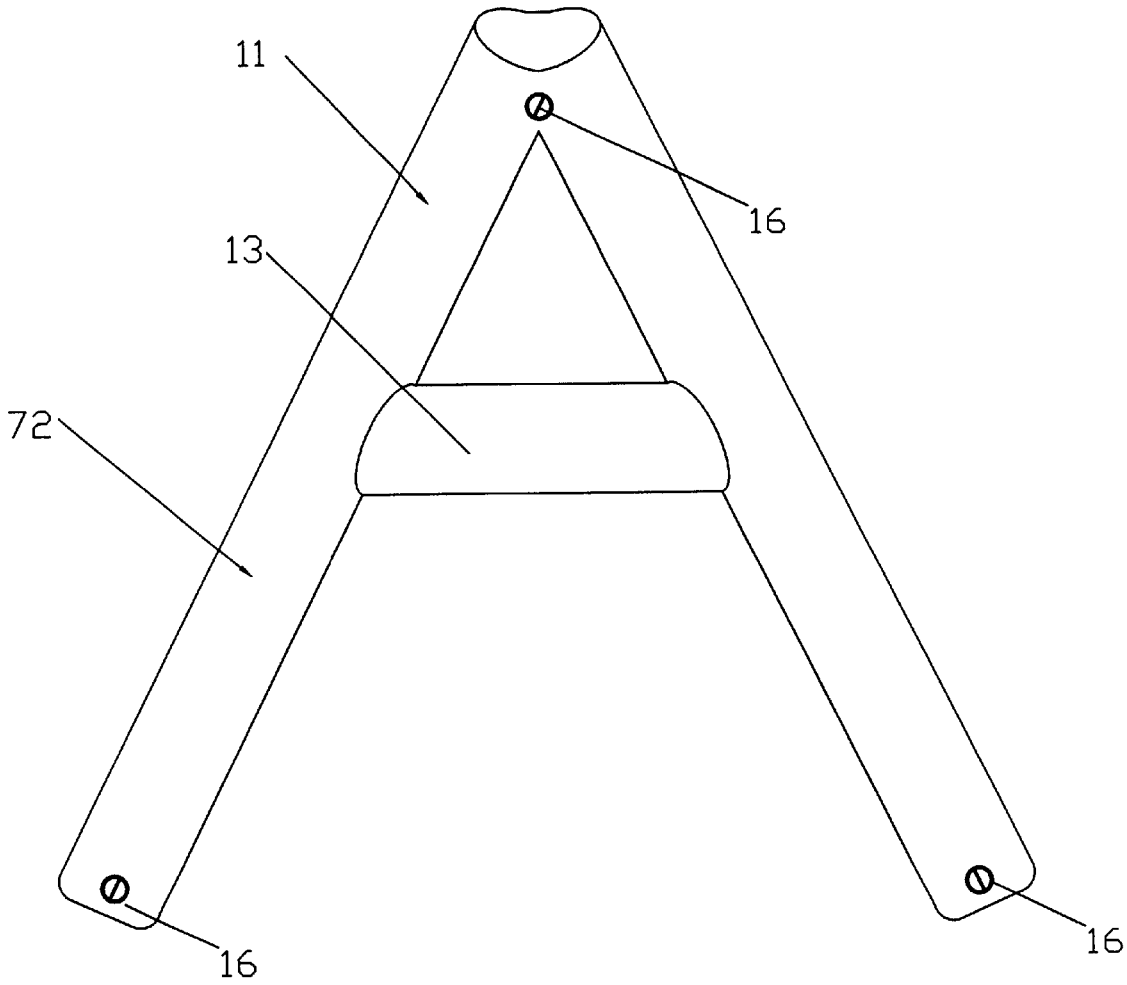
FIG. 15 is an elevation view of a tenth embodiment incorporated into one side of a swing.

Yet another embodiment (64) still is shown in FIGS. 13 and 14. This particular embodiment is similar to that of FIG. 1 with a couple of exceptions; one, it has an open, and unsealed top end (68), two, it has no center tube or cylinder (that function is provided by the swing leg itself), three, the bottom end leak resistant cuff (70) is cinched (66) around the swing leg to seal off the ballast and contain the ballasting medium (78), (preferably water). Other means for sealing the bottom might be a watertight elastic cuff. Other means for providing access to the top portion of the ballast might be snaps, hook and loop fastener, rope, nylon cable ties or draw strings. To fill with water, one merely opens the top cinch strap (66) and fills the ballast. The top end is closed off by way of the top cinch strap (66). This top closure is not meant to be leak proof; it does not need to be. For draining, it has a drain/fill valve (16) at the bottom. This embodiment eliminates some expensive sheet parts and some welding labor. It too could be made from either sheet construction or a one piece molded version and would act as a pad once filled and fully closed at the top and bottom.

Figure 16:
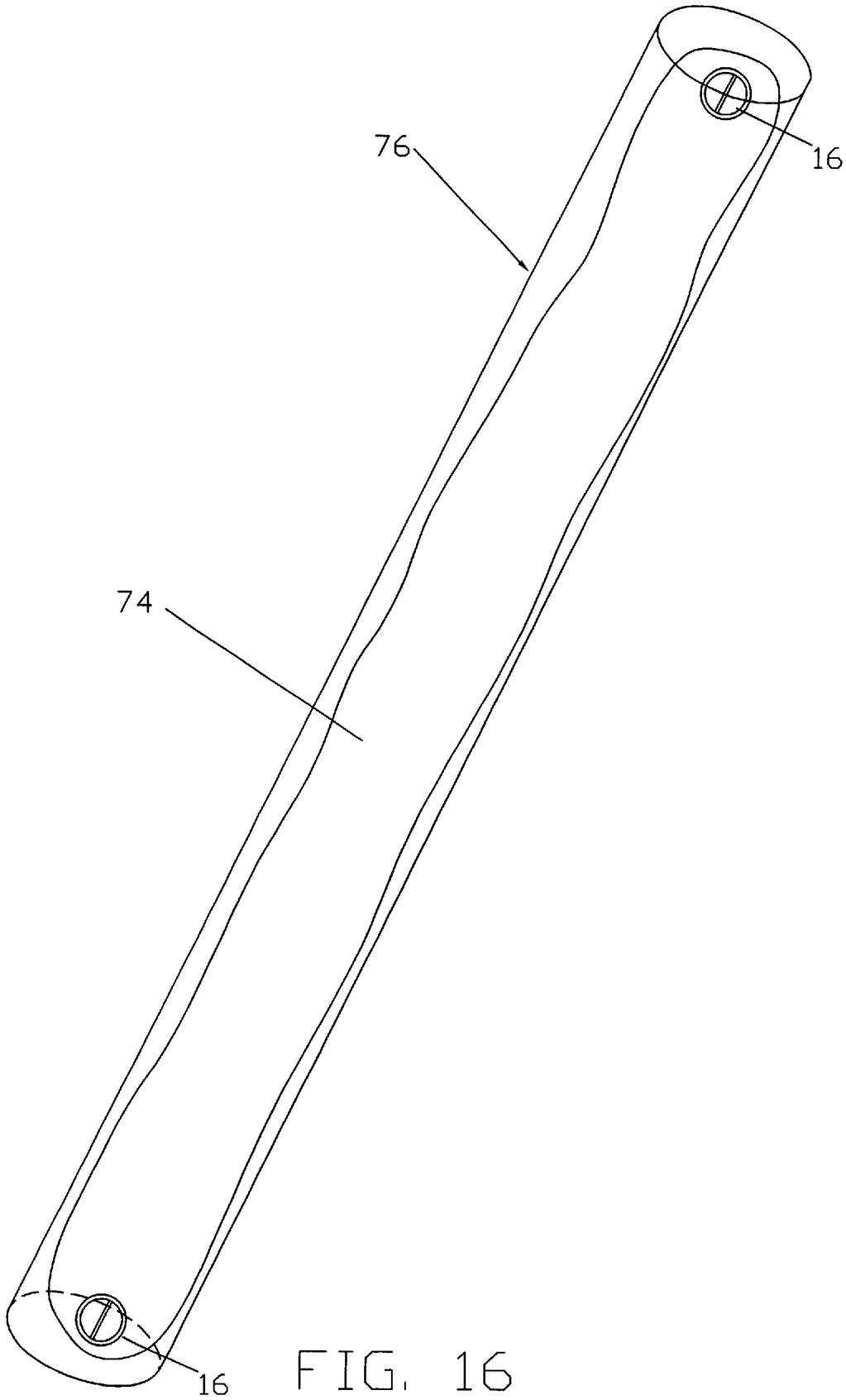
FIG. 16 is a perspective view of an eleventh embodiment in one leg of a swing.

Further embodiments (FIG. 15) may entail a swing set whose legs themselves (72) could be filled with water to act as ballasts. These legs (76) may be made of a polymeric material or steel tubing with a sort of inner bladder (74) to provide a leak/rust free vessel (FIG. 16).

Figure 17:
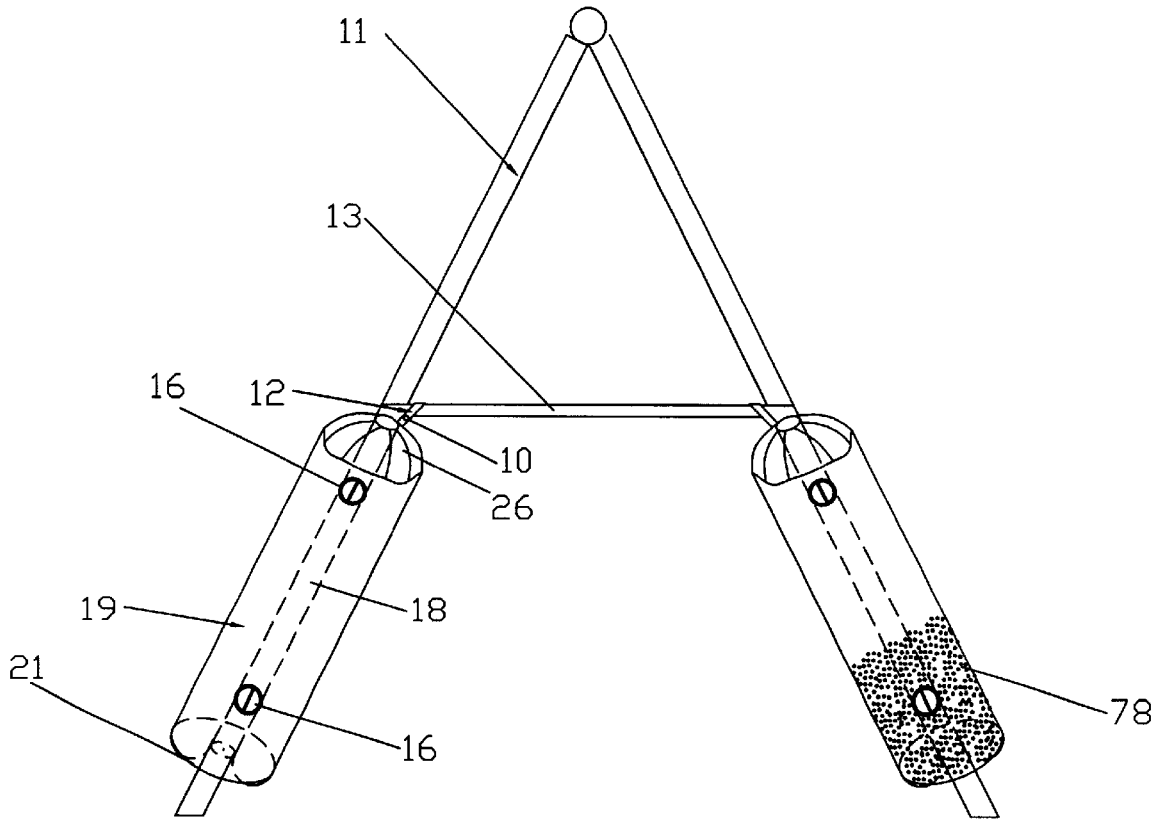
FIG. 17 is a perspective view of a twelfth embodiment, which is the same as the first embodiment minus the structural hub.

FIG. 17 shows an embodiment very similar to the first embodiment, except that in FIG. 17, the embodiment is shown with no structural hub (20).

From my description above, a number of advantages of my swing set ballast become evident:

a) This swing-ballasting device helps prevent a swing from tipping over while excessive riding is taking place and yet can be drained to make it light enough for a small child to manipulate or carry.

b) This swing-ballasting device is easy to find and purchase in an all inclusive package. The package includes all that is necessary to install and use the device. It can be made readily available at several major retail stores as well as on the World Wide Web.

c) This swing-ballasting device requires little or no assembly due to its simple design. It would be installable in seconds and take even less time to fill or drain.

d) This swing-ballasting device requires no tools to attach to the swing.

e) This swing-ballasting device allows for mobility of the swing/ballast assembly that is as good as the swing by itself. Once the ballast is void of any water, the swing set can be moved with no added inconvenience.

f) This swing-ballasting device helps prevent injury due to impact with the structure of the swing. This is achieved by creating a padded barrier between the hard rigid frame of the swing and children playing on or around the swing. This pad is an integral part of the ballast. It is the water-filled vessel/ballast itself.

g) This swing-ballasting device will not cause any damage to the lawn or sprinkler system above and beyond that which the swing set may cause on its own, without the ballasting device.

h) This swing-ballasting device has a form factor conducive to inexpensive global shipping rates. The device can be folded, rolled or compressed in order to reduce its shipping volume.

i) This swing-ballasting device has a form factor conducive to inexpensive packaging. The device can be folded, rolled or compressed in order to reduce its shipping volume and allow it to be packaged in a relatively small, inexpensive container.

j) This swing-ballasting device will pose no danger to children playing on or around the swing. It will not have any sharp edges or hard features that could otherwise injure a child.

k) This swing-ballasting device can be made in an assortment of bright colors and will add aesthetic value to the swing.

l) This swing ballasting device is inexpensive to manufacture m) Yet another advantage of this device is that it can be used without damaging the swing or its rust inhibiting coating.

The manner of using the swing set ballast is unlike any of the relevant art swing anchoring solutions. This ballast, in any of the seven configurations shown in FIGS. 1,2,3,4,8, 9,10,13,14 and 17 can be operated or used in the same manner. First, the ballast is taken out of the packaging. The top of the ballast can be identified by the retaining strap (12). One leg of the swing at a time is lifted several inches above the ground and the top end of the ballast is slipped onto and up the swing leg (11). The ballast is then slid up to the cross bar of the swing (13) where the retaining strap (12) is attached. The retaining strap (12) is properly attached by wrapping it around the cross bar (13) and securely snapping (10) it back onto itself. Once the ballast is hanging in proper position, the fill/drain valve (16) plug is removed and water is poured into the ballast via a hose or another suitable water source. As water is pored into the ballast, the ballast will expand to its maximum volume and mass. As the ballast is filled, air pressure can be relieved periodically via the unsealed top seam or via the upper valve depending on the configuration used. In the cases of embodiments shown in FIGS. 1,3,5,8,9 and 17, as the ballasts are filled with water, the center tube or cylinder (18) constricts around the swing leg (11). This provides for an enhanced and more secure fit with fewer tendencies for the ballast to want to slide down the swing leg under the acceleration of gravity. Once the ballast is completely full, the valve (16) plug can be replaced. Repeat as necessary depending on the number of ballasts purchased. The swing is ready for use.

The exact number of ballasts required for proper operation depends on the swing configuration. For instance, some swings have an auxiliary "ride", such as a slide, attached on the outside of one of the "A" shaped frame members. This type of additional or modular ride may help serve as a ballasting mechanism and ballasts may not be needed on that side. At least two ballasts are recommended for added tipping prevention, one on each of the opposing sides (front to back). Four ballasts, one on each outer leg, provides the optimal level of safety and convenience. When it is desirable to move the swing, the lower plug from each of the filled ballasts is removed and the water is drained. Once the water is drained, the swing can be moved as if it had never been modified. This can be done without detaching the ballasts from the swing. To prepare the swing for operation, simply refill the ballasts.

Accordingly, the reader will see that this swing set ballast can be used to securely, easily, and conveniently anchor a swing set, can be removed just as easily, and allows for rapid relocation of the swing without damage to the swing's surroundings or to the swing itself. In addition, this ballast provides an added measure of safety by padding the legs of the swing, which would otherwise be very hard, rigid and dangerous. Furthermore, the swing set ballast has the additional advantages in that It requires no tools for assembly, installation or operation;

It will pose no danger to children playing on or around the swing;

It is of a form factor desirable for packaging, shipping and handling;

The ballasting medium, water, is readily available and easily disposed of;

It is a solution designed specifically for the swing set ballasting application, not a clumsy use of existing materials and technology.

Although the description above contains many specifities, these should not be construed as limiting the scope of the invention but as merely providing illustrations of some of the presently preferred embodiments of the invention. For example, the ballast can be made of other materials besides thermoplastics. Thermoplastics are a good choice for manufacturability reasons. They are easily bonded together without the use of harmful, messy glues or solvents. Another example is the shape of the ballasts. The shape of the ballasts does not need to be cylindrical. The cylindrical shape helps maximize volume, minimize surface area and minimizes edges. Yet another example is the manufacturing techniques used to make the ballasts. Most of the previously mentioned embodiments could be manufactured in several different ways, including welding fabrication of an assembly or molding a one piece ballast in custom tooling.

Thus the scope of the invention should be determined by the appended claims and their legal equivalents, rather than by the examples given.

I claim:

1. A swing set ballasting arrangement comprising the following:

a swing set having at least one frame member;

a container adapted and constructed to hold ballast medium in sufficient quantity to hold the swing set in a generally stationary position during use;

a fill mechanism on the container;

a drain mechanism on the container; and an attachment mechanism adapted and constructed to secure the container to the at least one frame member.

2. A swing set ballasting arrangement in accordance with claim 1, wherein the container comprises an integral pad.

3. A swing set ballasting arrangement in accordance with claim 1, wherein the container comprises a selectively sealable main body tube forming inner and outer walls of the container.

4. A swing set ballasting arrangement in accordance with claim 1, wherein the container is fabricated as a thermoformed, expansible and compressible bellows.

5. A swing set ballasting arrangement in accordance with claim 1, wherein the container is fabricated as a thermoformed, unitary polymeric container.

6. A swing set ballasting arrangement in accordance with claim 1, wherein the swing set frame comprises at least two adjacent legs, and the attachment mechanism spans the adjacent legs simultaneously.

7. A swing set ballasting arrangement in accordance with claim 1, wherein the container comprises the following:

a thermoformed polymer inner wall; and a pliable polymeric fabric outer wall.

8. A swing set ballasting arrangement in accordance with claim 1, wherein the swings frame comprises at least one generally cylindrical leg, and the container comprises an inner wall formed by an outer surface of the leg, and an outer wall fabricated from polymeric fabric.

9. A swing set ballasting arrangement in accordance with claim 1, wherein the container comprises a leg of the swing set frame.

10. A swing set ballasting arrangement in accordance with claim 1, wherein the container comprises a bladder insert for a leg of the swing set frame.

11. A swing set ballasting arrangement in accordance with claim 1, wherein the container is adapted and constructed to be filled with a fluid ballasting medium, and further comprises an inner wall fabricated from a flexible material such that the inner wall of the container constricts around a leg of the swing set frame as the container is filled with ballasting medium.

12. A swing set ballasting arrangement in accordance with claim 1, wherein the container comprises the following:

a main body tube forming inner and outer walls of the container; and a structural support member disposed between the inner and outer walls of the container.

* * * * *

UNITED STATES PATENT AND TRADEMARK OFFICE

CERTIFICATE OF CORRECTION

PATENT NO. : 6,375,145 B1
DATED : April 23, 2002
INVENTOR(S) : David M. Payne

It is certified that error appears in the above-identified patent and that said Letters Patent is hereby corrected as shown below:

Column 2,
Line 15, "Modem" should read -- Modern --.

Signed and Sealed this

Second Day of July, 2002

*Attest:*

*Attesting Officer*

JAMES E. ROGAN
*Director of the United States Patent and Trademark Office*